US006910578B2

(12) United States Patent
Stern

(10) Patent No.: US 6,910,578 B2
(45) Date of Patent: Jun. 28, 2005

(54) PORTABLE HAND POWER TOOL ACCESSORY HOLDER

(76) Inventor: Jonathan S. Stern, 20 Gallivan St., Greenville, SC (US) 29609

( * ) Notice: Subject to any disclaimer, the term of this patent is extended or adjusted under 35 U.S.C. 154(b) by 104 days.

(21) Appl. No.: 10/426,192

(22) Filed: Apr. 30, 2003

(65) Prior Publication Data

US 2004/0055917 A1 Mar. 25, 2004

Related U.S. Application Data

(60) Provisional application No. 60/413,331, filed on Sep. 25, 2002.

(51) Int. Cl.[7] ..... B65D 5/28; A47F 7/00

(52) U.S. Cl. ..... 206/379; 206/350; 211/69.1; 211/70.6; 224/223

(58) Field of Search ..... 206/379, 373, 206/350; 81/490; 211/69–69.1, 70.6; 224/223, 904; 408/241 R

(56) References Cited

U.S. PATENT DOCUMENTS

| | | | | |
|---|---|---|---|---|
| 2,824,651 A | | 2/1958 | Davis | |
| 4,508,221 A | | 4/1985 | Olson | |
| 4,797,040 A | | 1/1989 | Hibbard | |
| 4,982,885 A | * | 1/1991 | Severson et al. | 224/675 |
| D314,699 S | | 2/1991 | Tamosaitis et al. | |
| 5,056,661 A | | 10/1991 | Balzano | |
| 5,188,242 A | | 2/1993 | Smith | |
| 5,333,767 A | | 8/1994 | Anderson | |
| D369,078 S | | 4/1996 | Anderson | |
| D371,945 S | | 7/1996 | Geary et al. | |
| 5,810,525 A | | 9/1998 | Ector, Sr. | |
| 5,842,584 A | * | 12/1998 | Baird | 211/69.1 |
| 6,098,558 A | | 8/2000 | Baird | |
| 6,729,480 B1 | * | 5/2004 | Blake | 211/70.6 |

* cited by examiner

*Primary Examiner*—Bryon P. Gehman
(74) *Attorney, Agent, or Firm*—McNair Law Firm, P.A.

(57) ABSTRACT

An accessory holder for releasably storing tool implements on a portable hand power tool. The holder includes a base strip of durable flexible material. An attachment member is carried by the base strip for releasably attaching the base strip to the tool. An elastic band is carried by the base strip to form a plurality of constricting sleeves for releasably engaging tool implements. A bit tube is disposed in at least one of the constricting sleeves for receiving tool implements. A restraining magnet is included in the bit tube for magnetically engaging tool implements and accessories in the tube. A utility magnet is carried by the elastic band for magnetically engaging tool implements for temporary storage. Accordingly, an accessory holder is provided for releasably storing tool implements on a portable power tool for quick and convenient access.

22 Claims, 4 Drawing Sheets

PORTABLE HAND POWER TOOL ACCESSORY HOLDER

Applicant claims priority of U.S. provisional application No. 60/413,331 filed Sep. 25, 2002.

FIELD OF THE INVENTION

The present invention relates to devices for carrying tool implements and accessories, and more particularly, to an accessory holder for carrying a variety of tool implements and accessories on the housing of a portable hand power tool.

BACKGROUND OF THE INVENTION

Today's hand held power tools utilize an extensive variety of interchangeable implements, accessories, and paraphernalia. The storage and retrieval of these accessories is a matter to which considerable attention has been devoted.

Various types of storage devices have been developed to organize and store variety of tool implements in a single box or container. Typically, however, these containers are designed to be hung on walls, carried in a larger tool box or the like, and are generally intended to provide a case for organizing a complete set of tool implements, such as a set of drill-bit, screw-bits, and the like for example. Typically, when using a tool with interchangeable implements, such as a cordless power drill, it is often necessary to change the tool implement to complete a task, requiring the user to return to the tool box in search of the correct implement for the current job. Alternatively, when working on a task that requires a plurality of tool implements, the drill-bits or screw-bits not currently in use are quite often momentarily placed in a pocket or the like, resulting in a time-consuming search for the correct accessory when it is desired to change the tool implement. Also, the tool implements can become damaged when placed together in a single pocket. Additionally, it is also common to temporarily store a plurality of tool implements on the top step of a ladder, while using the ladder to gain access to the task the tool is being used to complete. It is possible, and highly probable, that the tool implements will slide off the ladder, drop to the ground, and roll into a crack never to be seen again. Therefore, there is a substantial need for storing tool implements and accessories directly on the power tool in order to prevent their loss and damage as discussed above.

Several devices have been developed to address this problem of carrying power tool accessories directly on the tool itself. For example, U.S. Pat. No. 4,508,221 discloses a tool caddy for holding a variety of small tools of varying sizes, such as drill bits, saw blades, or the like. The tool caddy is designed to be adhesively attached to an electric drill or similar tool to keep the interchangeable tool elements readily at hand. The caddy uses a flat sheet of flexible material to attach to the drill. This sheet, however, is so large that it would cover vent slots in the housing of most portable drills, interfering in the operation of the tool. Additionally, many of today's drills include speed selection switches located in the top of the housing of the drill. This sheet would cover such switches, reducing the usable features of the drill. Accordingly, such a design is impractical for the majority of hand held power tools.

Another example of a device attempting to solve the problems associated with carrying tools implements on the power tool is U.S. Pat. No. 4,797,040. This patent discloses a strap on drill paraphernalia holding system that allows the user to store the drill paraphernalia needed for a particular job on the tool. The holding system includes a plurality of plastic cylinders attached to a flexible base that receive various drill bits. The plastic cylinders include a plurality of diaphragms with ribbed surfaces to secure the drill bits in the cylinders. The ribbed surface of the diaphragm allows it to perform as a variable opening that holds the bits in place. The plastic cylinders are a bulky and inefficient use of space around the housing of the tool. The bulky nature of the cylinders limits that available storage capacity for holding a variety of implements. Additionally, small screw bits may accidentally become completely recessed into the plastic cylinders, necessitating another tool to push the screw bit out of the cylinder.

Many of these devices use some type of strap which wraps around the housing of the power tool to carry the various implements. However, the majority of power tools incorporate trigger guards-and contoured ergonomic housings that make using such straps difficult.

Additionally, there is currently no device that uses magnetic force to store or temporarily secure implements and accessories, specifically screws and screw bits, to the power tool for easy access.

Accordingly, it is an object of the present invention to provide a portable hand power tool implement and accessory holder for storing a variety of interchangeable implements and accessories on the housing of the power tool in an efficient manner.

It is another object of the present invention to provide a portable hand power tool implement and accessory holder that does not require straps which wrap around the housing of the power tool to mount the holder to the tool.

It is another object of the present invention to provide a portable hand power tool implement and accessory holder that uses magnetic force to carry tool implements and accessories in a manner that allows for quick and convenient access and interchangeability.

It is another object of the present invention to provide a portable hand power tool implement and accessory holder that does not interfere in the operation of the power tool by covering vents or switches.

These and other objectives and advantages of the present invention will become apparent from the following more detailed description below.

SUMMARY OF THE INVENTION

The above objectives are accomplished according to the present invention by providing an accessory holder that includes a base strip of durable flexible material for attachment to a housing of a portable hand power tool. An attachment member is carried by the base strip for releasably attaching the base strip to the housing. An elastic band is carried by the base strip in a corrugated arrangement to form a plurality of open-ended constricting sleeves for engaging tool implements and accessories in a releasable manner between the elastic band and the base strip. Preferably, the open-ended constricting sleeves vary in size to receive a variety of different diameter tool implements and accessories. Additionally, to restrict the tool implements and accessories from sliding out of the constricting sleeves, at least one restraining magnet is disposed within at least one of the constricting sleeves for magnetically engaging the tool implements and accessories to be inserted into the constricting sleeves.

In the preferred embodiment, the restraining magnet disposed in the constricting sleeve is oriented perpendicular to the base strip and the elastic band to divide the open-ended constricting sleeve into two constricting bit sleeves for receiving and magnetically engaging tool implements and accessories.

In a further advantageous arrangement, the holder includes a bit tube disposed in at least one of the open-ended constricting sleeves that extends through the sleeve. A restraining magnet is carried within the bit tube dividing the bit tube into a first bit sleeve and a second bit sleeve for receiving and magnetically engaging tool implements and accessories. Preferably, the first bit sleeve has a diameter greater than the second bit sleeve for accommodating larger tool implements than the second bit sleeve.

Advantageously, the holder includes a switch recess formed into the flexible material of the base strip for contouring the base strip around a switch located in the housing of the power tool so that the switch, such as a sliding speed selection switch, can be operated without interference by the base strip.

The holder also includes a utility magnet carried by the base strip for magnetically engaging tool implements and accessories for temporary storage during tasks being performed with the power tool. Preferably, the utility magnet is disposed between the elastic band and the base strip to secure the utility magnet to the holder.

Preferably, a non-skid pad is carried by the base strip for engaging the housing of the power tool to restrict sliding of the base strip against the housing.

In a preferred embodiment of the holder, the attachment member includes a hook portion of hook-and-loop connector carried by the base strip, and a complementary loop portion of hook-and-loop connector mounted to the housing of the power tool. The hook portion engages the loop portion to secure the base strip to the housing of the power tool. Alternatively, the attachment member may also include a securing strap carried by the base strip for wrapping around the housing of the power tool to secure the base strip to the housing.

In a further advantageous embodiment, the attachment member includes an interlocking snap connector and the housing of the power tool includes an implement bracket disposed on the sides of the housing for holding tool implements. The interlocking snap connector is constructed and arranged to engage the implement bracket and secure the base strip to the housing. Preferably, a tab is included that extends outwardly from the snap connector for disengaging the snap connector from the implement bracket.

Thus, an accessory holder is provided for securely and releasably storing a variety of tool implements and accessories on a portable hand power tool for quick and convenient access and interchangeability.

BRIEF DESCRIPTION OF THE DRAWINGS

The invention will also be more readily understood from a reading of the following specification with reference to the accompanying drawings forming a part thereof, wherein an example of the invention is shown and wherein.

DETAILED DESCRIPTION OF A PREFERRED EMBODIMENT

Figure 1:
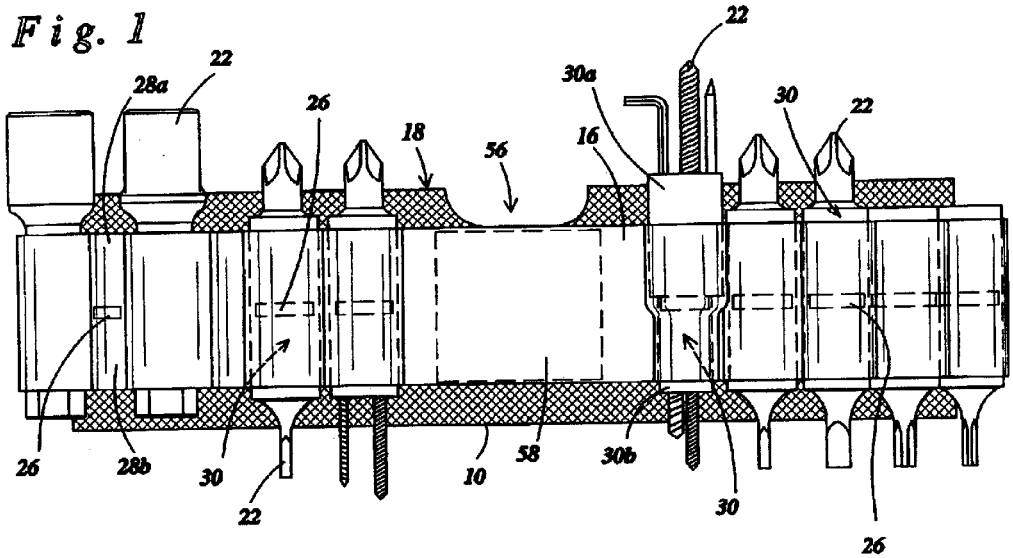
FIG. 1 is a top view of the accessory holder according to the invention.
Figure 4:
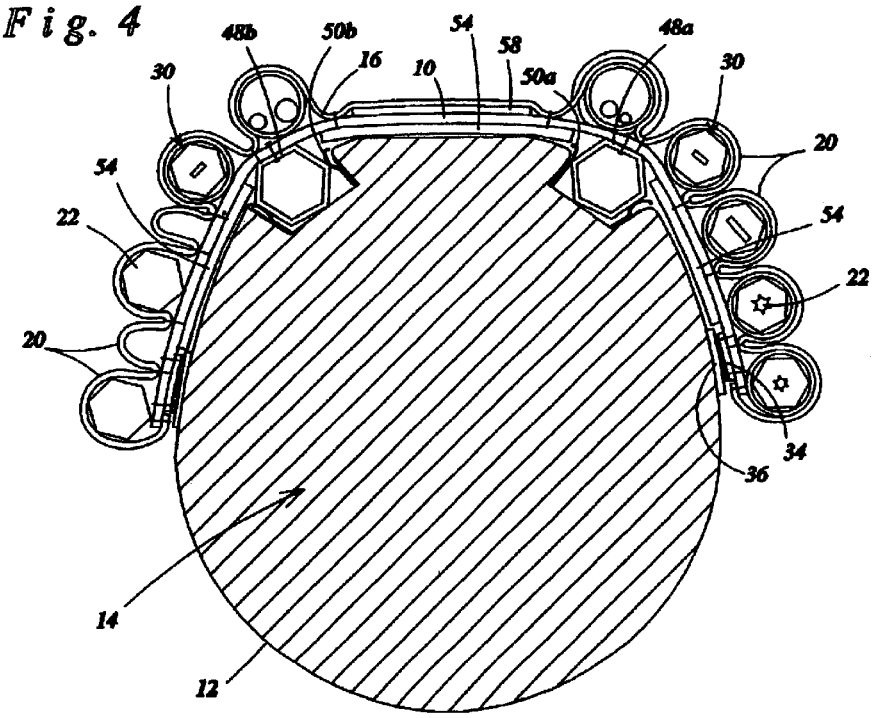
FIG. 4 is a side view of the accessory holder mounted to the housing of a portable hand power tool according to the invention.

Referring to the drawings, the invention will now be described in more detail. As shown in FIG. 1, a portable hand power tool accessory holder (hereinafter "holder"), is shown including a base strip 10 of durable flexible material for attachment to a housing 12 (FIG. 4) of a portable hand power tool, such as a cordless drill, designated generally as 14 (FIG. 4). Preferably, nylon strap is used to form the base strip due to its extremely durable nature and flexibility which allows the holder to conform to the shape of the drill housing. However, other materials such as plastic, whether flexible or hardened preformed, metal, such as aluminum, rubber and other suitably durable materials may be used.

Figure 2:
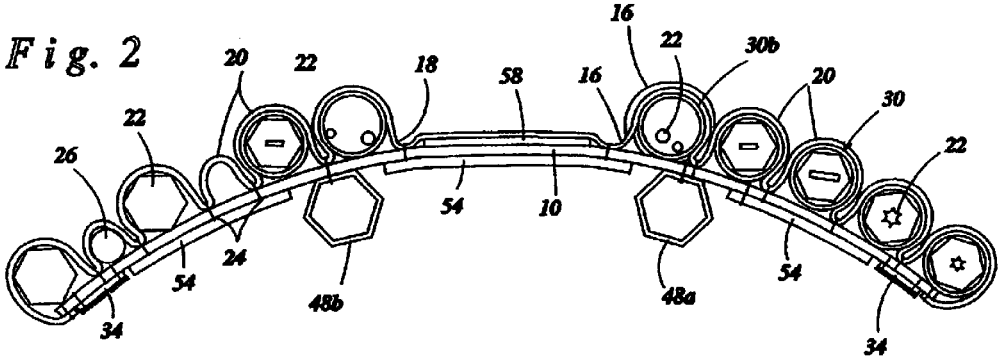
FIG. 2 is a side section view of the accessory holder according to the invention.

Referring to FIGS. 1 and 2, an elastic band 16 is mounted to a topside, designated generally as 18, of base strip 10. Elastic band 16 is preferably sewn to base strip 10 in a corrugated arrangement of ridges and grooves. The ridges and grooves form a plurality of open-ended constricting sleeves 20 for engaging tool implements 22 in a releasable manner between elastic band 16 and base strip 10. Elastic band 16 is sewn to the base strip at a first location, bunched slightly to create the constricting sleeve, and sewn again to secure the sleeve position. The procedure is repeated for the desired number of sleeves. By bunching the elastic band slightly before sewing it in position on the base strip, the sleeve remains slightly open to receive the tool implement, which makes it easier to insert the tool into the holder. By laterally spacing sewing points 24 at varying intervals, open-ended constricting sleeves 20 may be varied in size to receive a variety of different diameter tool implements and accessories 22.

When any tool implements are placed in constricting sleeves 20, the elastic band stretches to conform to the shape and diameter of the implement. The constricting force of the elastic band wedges the implement between elastic band 16 and base strip 10 with sufficient force to prevent the implements from sliding out of the sleeves during normal use of the tool to which the holder is attached, as described below.

Additionally, to restrict the tool implements and accessories from sliding out of the constricting sleeves, at least one restraining magnet 26 is disposed within at least one of the constricting sleeves for magnetically engaging the tool implements and accessories to be inserted into the constricting sleeves. In the preferred embodiment, restraining magnet 26 is disposed in the constricting sleeve between base strip 10 and elastic band 16. The restraining magnet is oriented perpendicular to base strip 10 and elastic band 16 to divide the open-ended constricting sleeve, generally in half, into two constricting bit sleeves 28*a* and 28*b* for receiving and magnetically engaging tool implements and accessories. Tool implements such as screw bits are inserted into the constricting sleeves and abut the retraining magnet so that the magnetic force, along with the constriction of the elastic band secure the implements in the sleeves.

Figure 7:
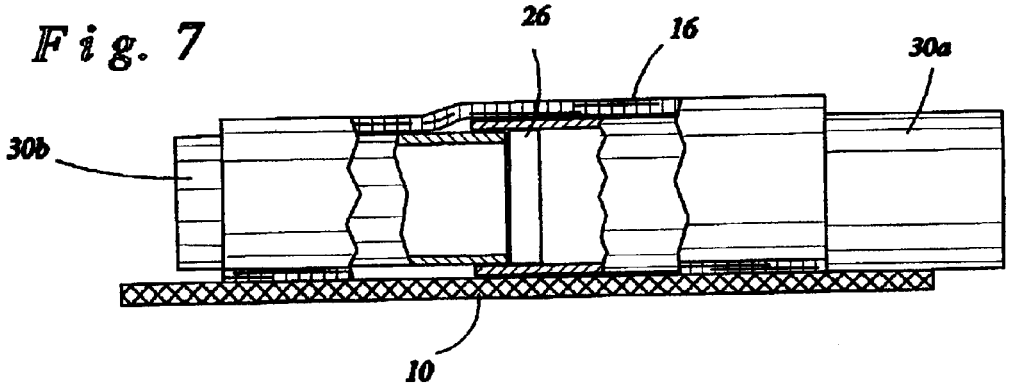
FIG. 7 is a cut-away cross-section view of the accessory holder according to the invention.

In a further advantageous arrangement, a bit tube, designated generally as 30, is disposed in at least one of the open-ended constricting sleeves and extends longitudinally through constricting sleeve 20. A restraining magnet 26 is disposed within bit tube 30 and oriented transverse to the bit tube to divide the tube into a first bit sleeve 30*a*, and a second bit sleeve 30*b*, for receiving and magnetically engaging tool implements and accessories 22. Referring to FIG. 7, first bit sleeve 30*a* preferably has a diameter greater than second bit sleeve 30*b* for accommodating larger tool implements than second bit sleeve 30*b*, or as shown in FIG. 1, for accommodating multiple tool implements and accessories in a single bit sleeve. Bit tube 30 is restrained in place by the constricting force of elastic band 16, but may also be further secured using adhesives to glue bit tubes 30 to base strip 10 and elastic band 16. In the preferred embodiment, bit tube sleeves 30*a* and 30*b* are slightly larger than the diameter of a standard screw bit so that the screw bit may be easily inserted into the bit sleeves to abut the restraining magnet. Unlike with the direct contact between constricting sleeve 20 and implements 22, once an implement comes into contact with restraining magnet 26, the magnetic force between the typically metal implement and the magnet is sufficient to secure the screw bit in the bit sleeve for normal use of the tool. This provides extremely easy and convenient placement of implements into the bit sleeves.

Figure 3:
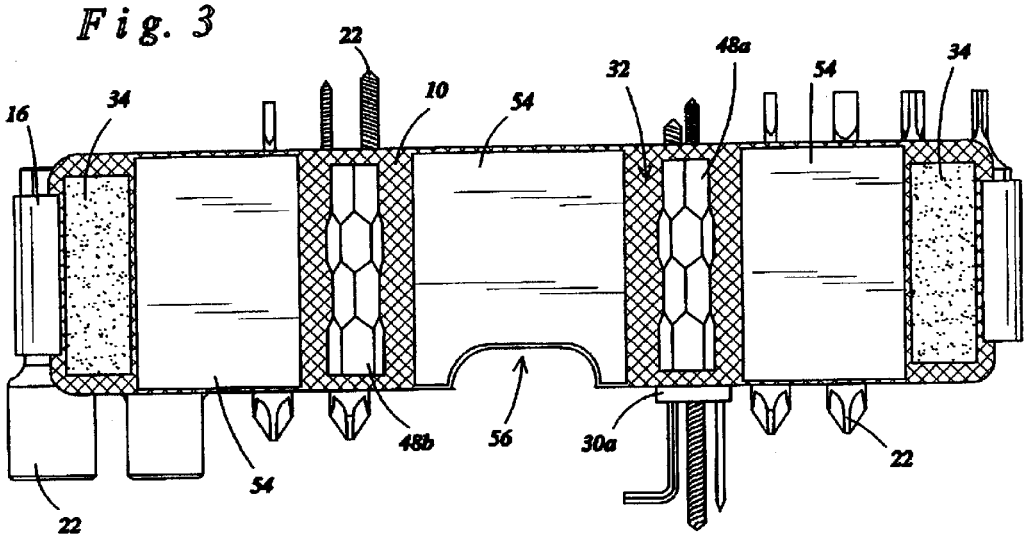
FIG. 3 is a bottom view of the accessory holder according to the invention.

Referring to FIGS. 3 and 4, an attachment member is carried on bottom side, designated generally as 32, of base strip 10 for releasably attaching base strip 10 to housing 12 of power tool 14. Various commonly known attachment members may be used, such as hook and loop connectors, straps, adhesives, and the like. In a preferred embodiment of the holder, the attachment member includes a hook portion 34 of hook-and-loop connector carried by base strip 10. A complementary loop portion 36 of hook-and-loop connector is mounted to housing 12 of power tool 14, typically using an adhesive backing on loop portion 36. As best shown in FIG. 4, hook portion 34 engages loop portion 36 to secure base strip 10 to housing 12 of power tool 14.

Figure 5:
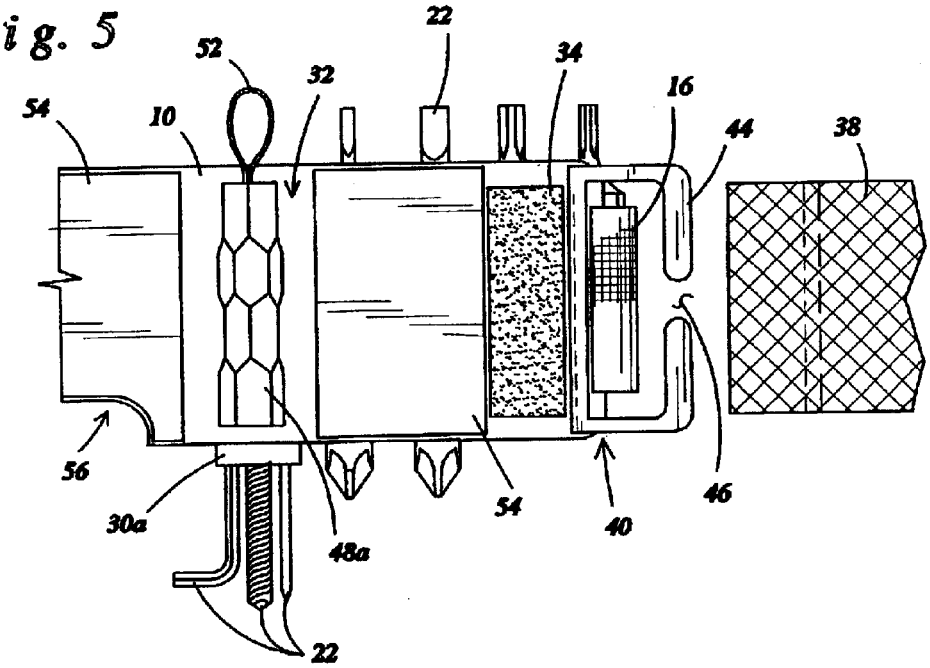
FIG. 5 is a detailed bottom view of the accessory holder according to the invention.
Figure 6:
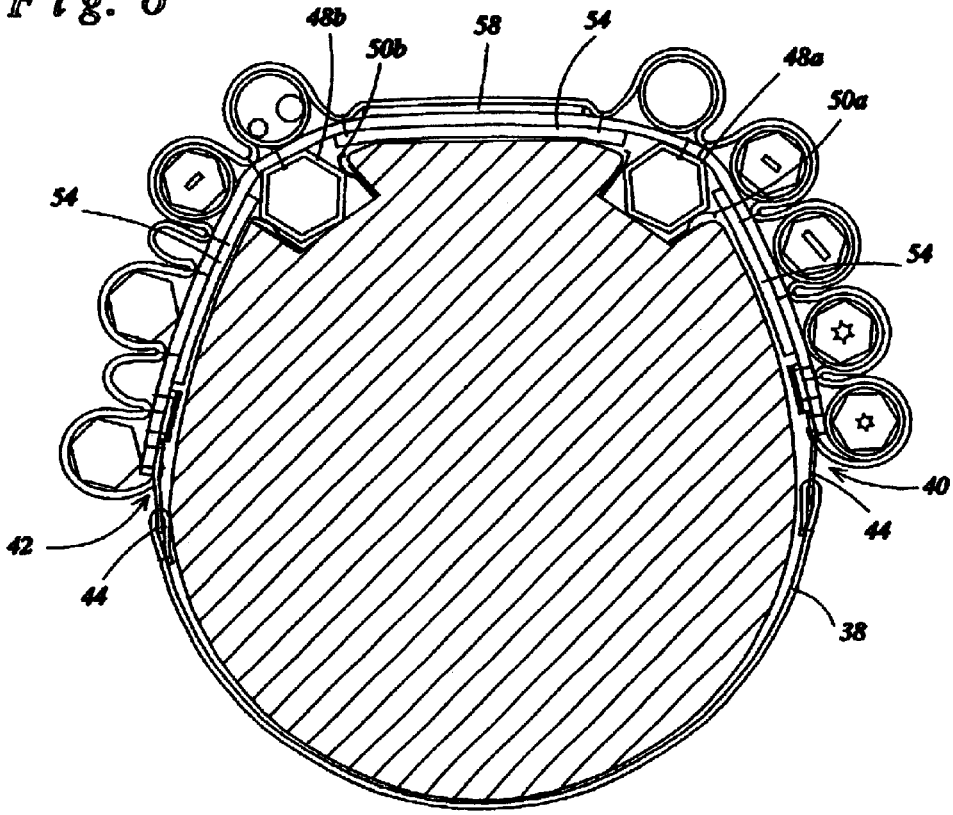
FIG. 6 is a side view of an alternative attachment method for the holder according to the invention.

Referring to FIGS. 5 and 6, either separately or in combination with the embodiment discussed above, the attachment member may also include a securing strap 38, or a plurality of securing straps for wrapping around housing 12 of power tool 14 to attach base strip 10 to the power tool housing. As best shown in FIG. 6, securing strap 38 is carried at a first distal end, designated generally as 40, of base strip 10 for wrapping around housing 12 of the power tool and engaging a second distal end, designated generally as 42, of base strip 10 to secure the base strip to the housing. Preferably, the holder includes a strap bracket 44 carried by base strip 10 at distal ends 40 and 42 for removably carrying securing strap 38. As shown in FIG. 5, strap bracket 44 includes an opening 46 for manipulating securing strap 38 on and off of strap bracket 44 to use as needed because of the alternative attachment methods discussed herein. Tension applied by securing strap 38 when wrapping around housing 12 causes securing strap 38 to pull distal ends 40 and 42 together and prevent base strip 10 from slipping off of power tool 14.

Referring to FIGS. 3 and 4, in a further advantageous embodiment, the attachment member comprises an interlocking snap connector. In the preferred embodiment shown in FIG. 3, two interlocking snap connectors 48*a* and 48*b* are carried on bottom side 32 of base strip 10 in a spaced horizontal arrangement. Each interlocking snap connector is constructed and arranged to engage implement brackets 50*a* and 50*b* in housing 12 of power tool 14. Typically, two implement brackets are disposed on opposite sides of the housing for holding standard screw-bits. Accordingly, interlocking snap connectors 48*a* and 48*b* are spaced on base strip 10 to engage implement brackets 50*a* and 50*b*, respectively, on each side of housing 12. The interlocking snap connectors are approximately the same diameter as the standard screw bits in order to properly engage implement brackets 50*a* and 50*b* and secure base strip 10 to the housing. Although the interlocking snap connectors depicted in the illustrations of the preferred embodiment are hexagonal in shape, the snap connectors can be square, cylindrical, or otherwise shaped to engage the screw bit brackets of the housing.

Referring to FIG. 5, a tab 52 is preferably included with at least one of interlocking snap connectors 48*a* and 48*b* that extends outwardly from the snap connector for disengaging the snap connector from the implement bracket when manually manipulated. The tab may extend from either end of the snap connector or in an outward perpendicular orientation, so that a user can grab or press the tab with his finger to release the snap connector from implement brackets 50*a* and 50*b*.

As best shown in FIG. 3, non-skid pads 54 are carried on bottom side 32 of base strip 10 for engaging the housing of the power tool to restrict sliding of base strip 10 against housing 12. Non-skid pads 54 are preferably made from a foam rubber material that can grip plastic and metal to prevent the base strip from shifting position around the housing.

Advantageously, as best shown in FIG. 1, base strip 10 also includes a switch recess, designated generally as 56, formed into the flexible material of base strip 10. The switch recess is basically a cutout section of the material in the base strip that allows the base strip to contour around a switch located in the housing of the power tool. Typically, power tools such as cordless drills include switches in the housing such as a sliding speed selection switch. The switch recess diverts the base strip around the switch area of the housing so that the switch can be operated without interference by base strip 10. As shown in FIG. 1, switch recess 56 is an inward curved recess, but may be formed from a variety of patterns and is not limited to the shape depicted in the illustrations.

Referring to FIGS. 1 and 2, the holder includes a utility magnet 58 carried by base strip 10 for magnetically engaging tool implements and accessories for temporary storage during tasks being performed with the power tool. The utility magnet is preferably formed using semi-flexible rubberized magnets and the like, which allow them to be sewn directly to either elastic band 16 and/or base strip 10. Adhesives and other commonly known techniques could be used equally as well. Preferably, utility magnet 58 is disposed between elastic band 16 and base strip 10 to hold the magnet in place and increase its durability.

Figure 8:
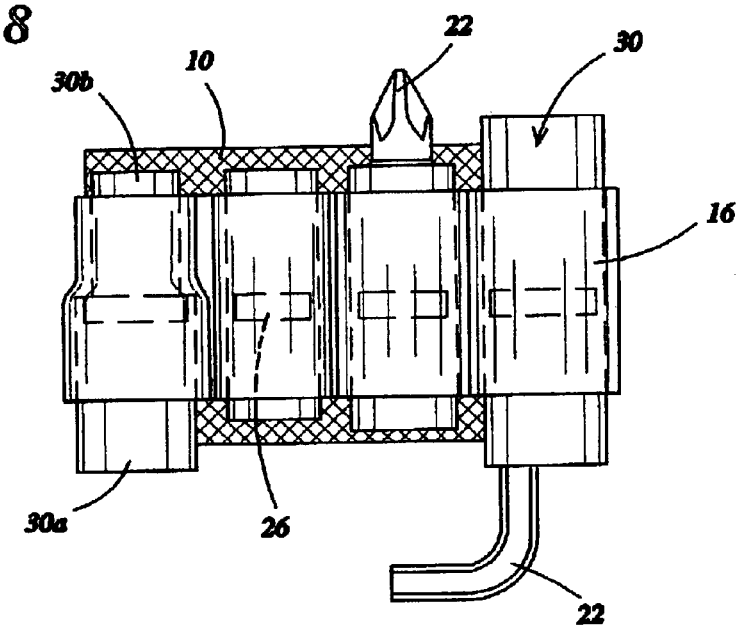
FIG. 8 is a detailed top view of an alternative embodiment according to the invention.
Figure 9:
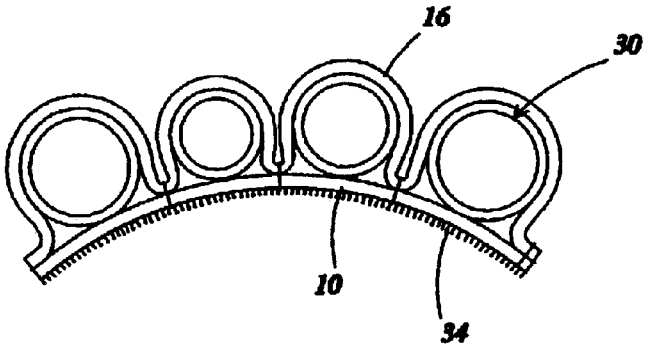
FIG. 9 is a side view of an alternative embodiment according to the invention.

Referring to FIGS. 8 and 9, an alternative embodiment of the holder is shown in which base strip 10 is formed using a hook portion 34 of hook and loop connector. In this embodiment, the base strip is formed from the attachment member in order to simplify manufacturing and improve cost efficiency. As such, elastic band 16 is sewn directly to hook portion 34 of hook and loop connector and attached to housing 12 as described above without a nylon band acting as the base strip.

While a preferred embodiment of the invention has been described using specific terms, such description is for illustrative purposes only, and it is to be understood that changes and variations may be made without departing from the spirit or scope of the following claims.

What is claimed is:

1. An accessory holder for releasable storing a variety of hand tool implements and accessories of varying size on a portable hand power tool, said holder comprising:

a base strip for attachment to a housing of a portable hand power tool;

an attachment member carried by said base strip for releasably attaching said base strip to the housing;

an elastic band mounted to said base strip in a corrugated arrangement to form a plurality of open-ended constricting sleeves for engaging tool implements and accessories in a releasable manner between said elastic band and said base strip;

at least one restraining magnet disposed within at least one of said constricting sleeves for magnetically engaging the tool implements and accessories to be inserted into said constricting sleeves to restrict the tool implements and accessories from sliding out of said constricting sleeves; and, said at least one restraining magnet dividing at least one of said open-ended constricting sleeves into two constricting bit sleeves for receiving and magnetically engaging tool implements and accessories;

whereby said accessory holder securely and releasably stores a variety of tool implements and accessories on the portable hand power tool for quick and convenient access and interchangeability.

2. The holder of claim 1 wherein said open-ended constricting sleeves vary in size to receive a variety of different diameter tool implements and accessories.

3. The holder of claim 1 including a switch recess included in said base strip for contouring said base strip around a switch located in the housing of the power tool so that the switch can be operated without interference by said base strip.

4. The holder of claim 1 including a utility magnet carried by said base strip for magnetically engaging tool implements and accessories for temporary storage during tasks being performed with the power tool.

5. The holder of claim 4 wherein said utility magnet is disposed between said elastic band and said base strip to secure said utility magnet to said holder.

6. The holder of claim 1 including a non-skid pad carried by said base strip for engaging said housing to restrict sliding of the base strip against the housing.

7. The holder of claim 1 wherein said attachment member includes a hook portion of a hook-and-loop connector carried by said base strip, and a complementary loop portion of said hook-and-loop connector carried by the housing of the power tool; said hook portion engaging said loop portion to secure said base strip to the housing of the power tool.

8. The holder of claim 1 wherein said attachment member includes a securing strap carried by said base strip for wrapping around the housing of the power tool to secure said base strip to the housing.

9. The holder of claim 1 wherein said attachment member includes an interlocking snap connector, and the housing of the power tool includes an implement bracket carried by the housing for holding tool implements; said interlocking snap connector constructed and arranged to engage the implement bracket to secure said base strip to the housing.

10. The holder of claim 9 including a tab extending outwardly from said snap connector for disengaging said snap connector from the implement bracket.

11. An accessory holder for releasably storing a variety of hand tool implements and accessories of varying size on a portable hand power tool, said holder comprising:

a base strip for attachment to a housing of a portable hand power tool;

an elastic band carried by said base strip in a corrugated arrangement to form a plurality of constricting sleeves for engaging tool implements and accessories in a releasable manner between said elastic band and said base strip;

a utility magnet carried by said base strip between a pair of laterally spaced constricting sleeves to provide an unrestricted open magnetic receiving area for magnetically engaging tool implements and accessories for temporary storage during tasks being performed with the power tool; and an attachment member carried by said base strip for releasably attaching said base strip to the housing;

whereby said accessory holder for securely and releasably stores a variety of tool implements and accessories on the portable hand power tool for quick and convenient access and interchangeability.

12. The holder of claim 11 wherein said utility magnet is disposed between said elastic band and said base strip to secure said utility magnet to said holder.

13. The holder of claim 11 including at least one restraining magnet disposed within at least one of said constricting sleeves, and said at least one restraining magnet dividing at least one of said constricting sleeves into two constricting bit sleeves for receiving and magnetically engaging tool implements and accessories.

14. The holder of claim 11 including a bit tube disposed in any one of said constricting sleeves and extending through the sleeve; a restraining magnet carried within said bit tube dividing said bit tube into a first bit sleeve and a second bit sleeve for receiving and magnetically engaging tool implements and accessories.

15. The holder of claim 14 wherein said first bit sleeve has a diameter greater than said second bit sleeve for accommodating larger tool implements than said second bit sleeve.

16. The holder of claim 11 including a switch recess included in said base strip for contouring said base strip around a switch located in the housing of the power tool so that the switch can be operated without interference by said base strip.

17. The holder of claim 11 wherein said attachment member includes an interlocking snap connector, and the housing of the power tool includes an implement bracket carried by the housing for holding tool implements; said interlocking snap connector constructed and arranged to engage the implement bracket to secure said base strip to the housing.

18. An accessory holder for releasably storing a variety of hand tool implements and accessories of varying size on a portable hand power tool, said holder comprising:

a base strip for attachment to a housing of a portable hand power tool;

an elastic band carried by said base strip in a corrugated arrangement to form a plurality of constricting sleeves for engaging tool implements and accessories in a releasable manner between said elastic band and said base strip;

a bit tube disposed in any one of said constricting sleeves and extending through the sleeve for receiving tool implements;

said bit tube including a restraining magnet for magnetically engaging tool implements and accessories, said restraining magnet carried within said bit tube to divide said bit tube into a first bit sleeve and a second bit sleeve for receiving and magnetically engaging tool implements and accessories, and, an attachment member carried by said base strip for releasably attaching said base strip to the housing;

whereby said accessory holder securely and releasably stores a variety of tool implements and accessories on the portable hand power tool for quick and convenient access and interchangeability.

19. The holder of claim 18 wherein said first bit sleeve has a diameter greater than said second bit sleeve for accommodating larger tool implements than said second bit sleeve.

20. The holder of claim 18 including a utility magnet carried by said base strip for magnetically engaging tool implements and accessories for temporary storage during tasks being performed with the power tool.

21. The holder of claim 18 including a switch recess included in said base strip for contouring said base strip around a switch located in the housing of the power tool so that the switch can be operated without interference by said base strip.

22. The holder of claim 18 wherein said attachment member including an interlocking snap connector for engaging an implement bracket carried by the housing to secure said base strip to the housing.

* * * * *